US005908593A

United States Patent [19]

Kikutani et al.

[11] Patent Number: 5,908,593

[45] Date of Patent: Jun. 1, 1999

[54] METHOD OF MANUFACTURING FIBERS WITH OPTICAL FUNCTION

[75] Inventors: Takeshi Kikutani, Tokyo; Katsumi Morohoshi, Yokosuka; Susumu Shimizu, Hadano; Akio Sakihara, Isehara; Kinya Kumazawa, Yokosuka; Hiroshi Tabata, Yokohama, all of Japan

[73] Assignees: Nissan Motor Co., Ltd., Yokohama; Tanaka Kikinzoku Kogyo K.K., Tokyo, both of Japan

[21] Appl. No.: 08/969,705

[22] Filed: Nov. 26, 1997

Related U.S. Application Data

[63] Continuation of application No. 08/602,058, Feb. 15, 1996, abandoned.

[30] Foreign Application Priority Data

Feb. 16, 1995 [JP] Japan ..... 7-028519

[51] Int. Cl.[6] ..... D01D 5/253

[52] U.S. Cl. ..... 264/177.13; 425/461; 425/464

[58] Field of Search ..... 264/177.13; 425/461, 425/464

[56] References Cited

U.S. PATENT DOCUMENTS

| | | | |
|---|---|---|---|
| 3,551,279 | 12/1970 | Ando et al. . | |
| 4,514,459 | 4/1985 | Nakagawa et al. | 428/229 |
| 5,407,738 | 4/1995 | Tabata et al. | 428/229 |

FOREIGN PATENT DOCUMENTS

| | | |
|---|---|---|
| 399 397 | 11/1990 | European Pat. Off. . |
| 1 785 209 | 5/1972 | Germany . |
| 43-14185 | 6/1968 | Japan . |
| 59-228042 | 12/1984 | Japan . |
| 60-24847 | 6/1985 | Japan . |
| 62-170510 | 7/1987 | Japan . |
| 1-139803 | 6/1989 | Japan . |
| 6-17349 | 1/1994 | Japan . |
| WO 93/01779 | 2/1993 | WIPO . |
| WO 94/05244 | 3/1994 | WIPO . |

OTHER PUBLICATIONS

Journal of Textile Machine Society, vol. 42, No. 2, pp. 55–62(1989).

Journal of Textile Machine Society, vol. 42, No. 10, pp. 60–68(1989).

Hansen, H., "Verschiedenartiger Glanz von Textilien durch Einsatz von Chemiefasern," *Chemiefasern*, Dec. 1968, pp. 926–928.

Patents Abstracts of Japan, JP 62–97909, C–451, vol. 11, No. 31, Oct. 14, 1987.

*Primary Examiner*—Leo B. Tentoni
*Attorney, Agent, or Firm*—Foley & Lardner

[57] ABSTRACT

A method of manufacturing fibers with optical function includes spinning a thermoplastic polymer by a spinneret having an opening with first slits arranged parallel to each other and a second slit arranged perpendicular thereto, the spinneret being formed to satisfy a predetermined relation between the length of the first slits and the width of the second slit.

23 Claims, 4 Drawing Sheets

METHOD OF MANUFACTURING FIBERS WITH OPTICAL FUNCTION

This application is a continuation of application Ser. No. 08/602,058, filed Feb. 15, 1996, now abandoned.

BACKGROUND OF THE INVENTION

The present invention relates generally to a method of manufacturing fibers with optical function in accordance with a melt spinning method and more particularly, to a method of manufacturing fibers with optical function, which reflect ultraviolet (UV) or infrared (IR) ray or show colors by reflection, interference, diffraction, or scattering phenomena of visible light ray.

Conventionally, a method of adopting inorganic or organic dyes and pigments or scaterring bright members has been in general use for providing various fibers and car coatings with desired colors or improved visual quality.

Recently, with an user's tendency to a high fabric quality, etc., there are increasing demands on graceful and quality minute structures which have colors varying with a change in the angle of view and having high chromas.

Some minute structures are developed and proposed to satisfy the above demands. One is a material showing a color by reflection, interference, diffraction or scattering without using dyes and pigments. The other is a material showing a deeper and brighter color by combining the above optical action and the dyes and pigments.

JP 43-14185 and JP-A 1-139803 disclose coated-type composite fibers with iridescence which are made of two or more resins having different optical refractive indexes. A journal of the Textile Machinery Society of Japan (Vol. 42, No. 2, pp. 55–62, published in 1989 and Vol. 42, No. 10, pp. 60–68, published in 1989) describes laminated photo-controllable polymer films for showing colors by optical interference, wherein a film with anisotropic molecular orientation is interposed between two polarizing films.

JP-A 59-228042, JP-B2 60-24847, and U.S. Pat. No. 4,514,459 disclose fabrics with iridescence conceived, e.g. from a South American morpho-butterfly which is well-known by its bright color tone varying with a change in the angle of view.

JP-A 62-170510 discloses fibers which show interference colors due to recesses with a predetermined width formed on the surface of the fibers. This document describes that formed fibers are fast and permanent in color due to no use of dyes and pigments.

With the minute structures as disclosed in JP 43-14185 and JP-A 1-139803, it is difficult to form fine fibers and minute chips or pieces, and to control the dominant wavelength (so-called "peak wavelength") of reflecting visible light ray.

On the other hand, with the minute structures as disclosed in JP-A 59-228042, JP-B2 60-24847, U.S. Pat. No. 4,514,459, and JP-A 62-170510, it is difficult to obtain desired coloring effect due to indefinite dimension (thickness, length, and refractive index) of the minute structures, etc.

For solving such inconveniences, JP-A 6-017349 (=U.S. Pat. No. 5,407,738) proposes new minute structures for showing bright and permanent colors varying with a change in the angle of view by reflection and interference of visible light ray. In this document, fibers have a cross section with parallel fin portions and a center or core portion perpendicular thereto, the parallel fin portions serving to reflect ultraviolet or infrared ray, or show colors by reflection and interference of visible light ray.

However, with the minute structures as disclosed in JP-A 6-017349 (=U.S. Pat. No. 5,407,738), it is difficult to form, e.g. the parallel fin portions of the fibers very thinly with a slight error and a reduced manufacturing cost.

It is, therefore, an object of the present invention to provide a method of manufacturing fibers having a predetermined function of reflection and interference with accuracy and a reduced manufacturing cost.

SUMMARY OF THE INVENTION

According to one aspect of the present invention, there is provided a method of manufacturing fibers, comprising the steps of:

preparing a thermoplastic polymer; and spinning said thermoplastic polymer by a spinneret, said spinneret having an opening with at least one group of first slits arranged parallel to each other and one second slit arranged perpendicular thereto, said spinneret being formed to satisfy a predetermined relation between a length of said at least one group of first slits and a width of said one second slit.

Another aspect of the present invention lies in providing a system for manufacturing fibers, comprising:

means for preparing a thermoplastic polymer; and means for spinning said thermoplastic polymer, said spinning means including a spinneret, said spinneret having an opening with at least one group of first slits arranged parallel to each other and one second slit arranged perpendicular thereto, said spinneret being formed to satisfy a predetermined relation between a length of said at least one group of first slits and a width of said one second slit.

DETAILED DESCRIPTION OF THE INVENTION

Figure 1A:
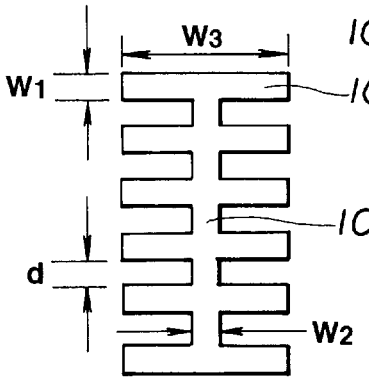
FIGS. 1A–1E are diagrammatic views showing examples of an opening of a spinneret used in the present invention.

Referring to the drawings, a description will be made with regard to preferred embodiments of a method of manufacturing fibers with optical function according to the present invention.

Referring first to FIGS. 1A–1E, a spinneret to which the present invention is applied to is formed with an opening having at least one group of first slits 101 having the same width and arranged parallel to each other at regular intervals, and a second slit 102 arranged perpendicular to the first slits.

Figure 1B:
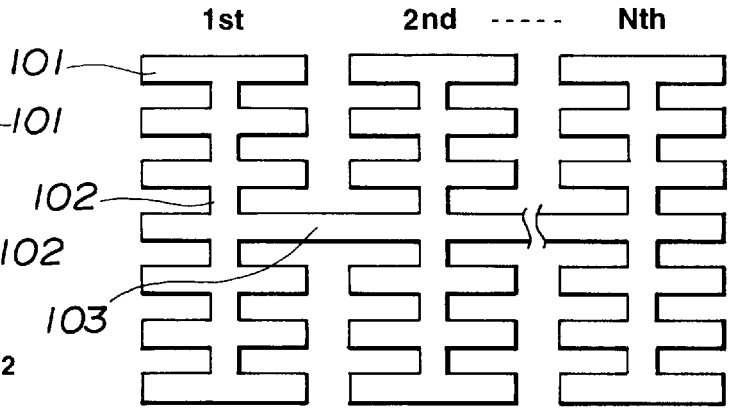
Figure 1C:
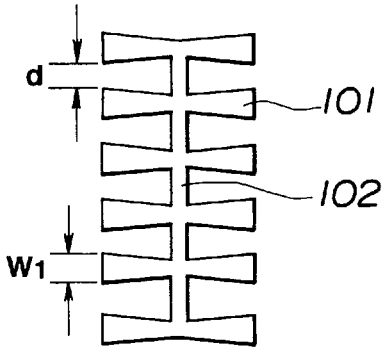
Figure 1D:
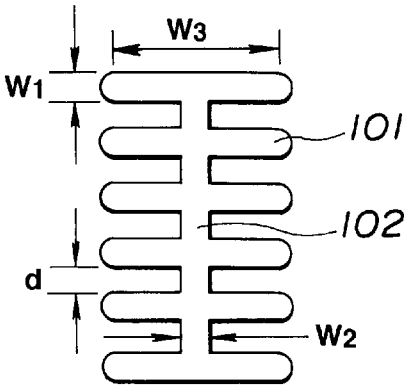
Figure 1E:
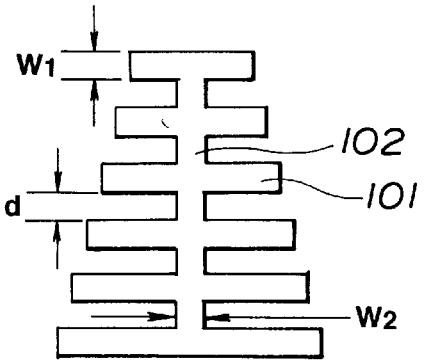

FIGS. 1A–1E show examples of a cross section of the opening of the spinneret. Referring to FIG. 1A, the spinneret has first slits 101 arranged parallel to each other, and a second slit 102 arranged perpendicular thereto. Referring to FIG. 1B, the spinneret has groups of the first slits 101 and second slit 102, and a connecting slit arranged in the middle of the first slits 101. Referring to FIG. 1C, the first slits 101 have wider ends than an intersection with the second slit 102. Referring to FIG. 1D, the first slits 101 is shaped in an ellipse in place of a rectangle as shown, e.g. in FIG. 1A. Referring to FIG. 1E, the first slits 101 have a length increased gradually from one end of the second slit 102 to the other end thereof.

As seen from the foregoing, the present invention is applicable whether the first slits 101 is rectangular or elliptic. Moreover, the number of the first slits 101 is six or seven in FIGS. 1A–1E, alternatively, it may be two or more as disclosed in JP-A 6-017349 (=U.S. Pat. No. 5,407,738) which is incorporated herein for reference.

When the width of the first slits 101 is $W_1$, the length thereof is $W_3$, the width of the second slit 102 is $W_2$, and the interval between the first slits 101 is "d", the spinneret should be formed to satisfy the following formula:

$$3\ W_2 \leqq W_3 \tag{1}$$

Also, the spinneret should be formed to satisfy the following formulae:

$$0.03\ \text{mm} \leqq W_1 \tag{2}$$

$$1 \leqq d/W_1 \leqq 30 \tag{3}$$

A description will be made with regard to the reason why the formula (1) should be satisfied. As disclosed in JP-A 6-017349 (=U.S. Pat. No. 5,407,738), the formula (1) is necessary for fibers with optical function to carry out effective reflection and interference of predetermined wavelengths of light ray. When the formula (1) is not established, the width $W_2$ of the second slit 102 is greater, ensuring insufficiently a laminated area of parallel fin portions of fibers for presenting reflection and interference.

The spinneret should be formed, preferably, to satisfy the following formula:

$$5\ W_2 \leqq W_3 \tag{4}$$

Figure 5A:
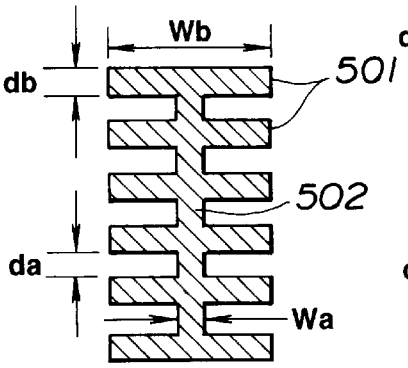
FIGS. 5A and 5B are views similar to FIGS. 1A–1E, showing the shape of a cross section of fibers with optical function obtained according to the present invention.

The formula (4) is desirable since even if, under the conditions of the formula (1), a thermoplastic polymer such as polystyrene (PS) or polypropylene (PP) is extruded from the opening of the spinneret as shown in FIG. 1A to obtain fibers with a cross section as shown in FIG. 5A, a cross section of fibers as actually obtained has a transcription factor less than 0.6 due to great Barus effect, resulting in a difficulty of satisfying the formula (1).

Next, a description will be made with regard to the reason why the formula (2) should be satisfied. First, in view of an aspect ratio of the thickness of a material (such as stainless steel) for defining the first slits 101 to the width thereof, narrower first slits 101 are essentially difficult to be formed. If such narrower first slits 101 can be formed by special electric discharge machining, etc., they cannot resist a pressure of a melt polymer extruded therefrom, which increases in proportion with a reduced opening area of the first slits 101, having a problem of the strength.

Second, as will be described later, if the width $W_1$ of the first slits is less than 0.03 mm, a shear rate of a melt polymer extruded therefrom is extremely increased, resulting in uncontrollable shape of a cross section of formed fibers, i.e. reduced transcription factor.

If a cross-sectional area of the first slits 101 is increased, i.e. the length $W_3$ is increased sufficiently, to prevent the above extrusion pressure from increasing, another problem arises that nonuniform pressure distribution is produced in the first slits 101.

It will be understood from the foregoing that the width $W_1$ of the first slits 101 can be determined to a desired value which is equal to or more than 0.3 mm. However, with an increase in the width $W_1$ of the first slits 101, the cross-sectional area thereof is increased to decrease the extrusion pressure, failing to provide an appropriate shear rate as will be described later. On the other hand, the smaller is the width $W_1$ of the first slits 101, the higher is a machining cost thereof.

Figure 2:
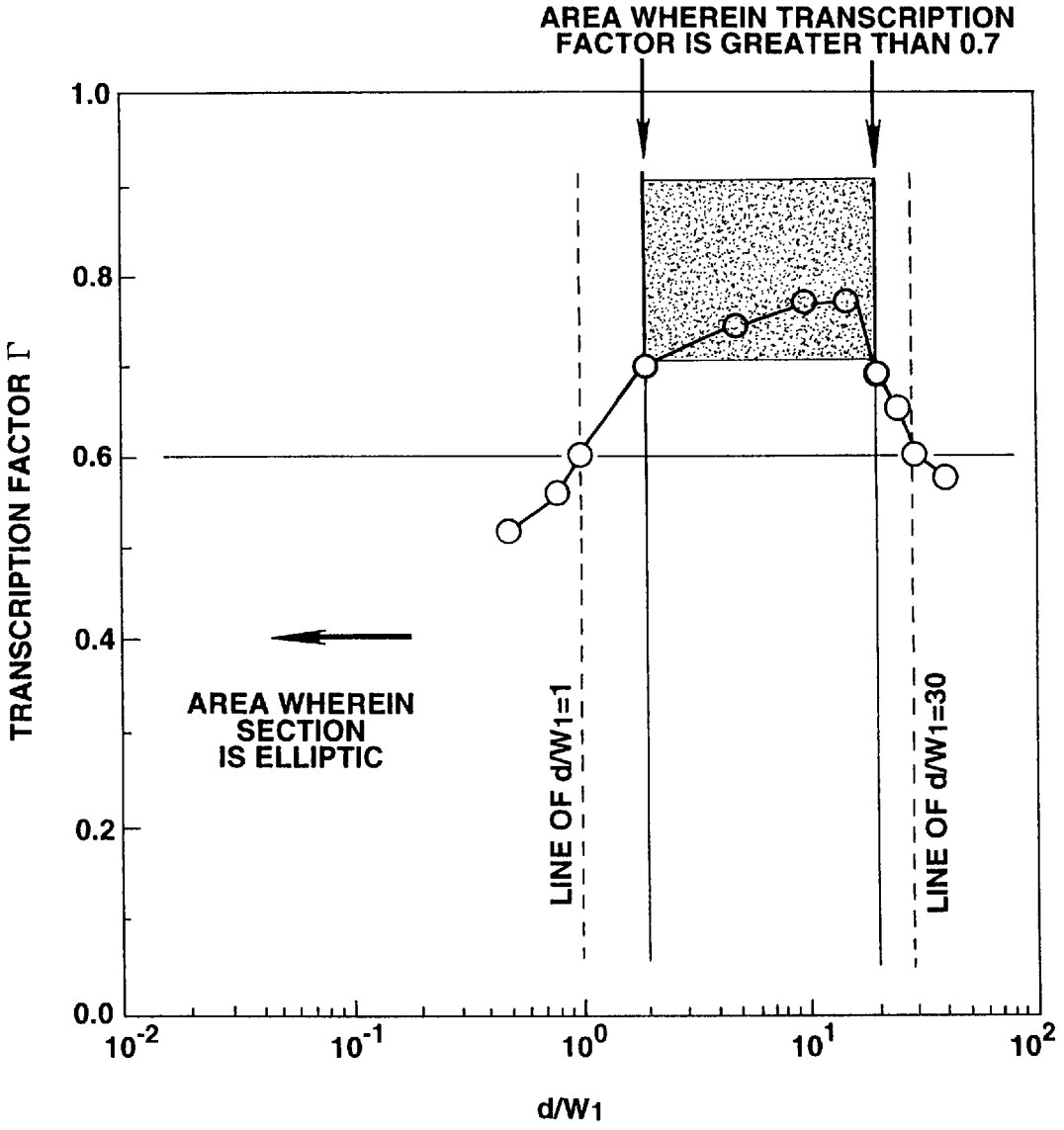
FIG. 2 is a graph illustrating the relation between a ratio of the interval between first slits to the width thereof, and a transcription factor of a cross section of formed fibers.

Referring to FIG. 2, a description will be made with regard to the reason why the formula (3) should be satisfied. FIG. 2 shows the relation between a ratio $d/W_1$ of the interval "d" between the first slits 101 to the width $W_1$ thereof, and a transcription factor ⌈ of a cross section of formed fibers. When the ratio $d/W_1$ is 0.5 or less, adjacent first slits 101 are too close, so that melt polymers extruded therefrom stick to each other. Thus, when using the spinneret having an opening shaped as shown in FIG. 1A, for example, a cross section of formed fibers is elliptic, and far from a level in which the transcription factor ⌈ can be considered as seen in a left area in FIG. 2. It is supposed that this results fundamentally from a surface tension of a melt polymer, Barus effect, etc. in addition to variable factors such as an applied polymer and spinning conditions. When the ratio $d/W_1$ is 1 or more, the transcription factor ⌈ is 0.6 or more, entering an area of so-called excellent transcription.

It is noted that the transcription factor ⌈ indicates the relation between the shape of a cross section of an opening of the spinneret and that of a cross section of fibers extruded therefrom. As the transcription factor ⌈ is greater, the shape of a cross section of fibers is nearer or similar to that of an opening of the spinneret. Here, the transcription factor ⌈ is defined as (complexity of formed fibers)/(complexity of the spinneret). Specifically, when the peripheral length of an opening of the spinneret is L, the cross-sectional area of the opening thereof is S, the peripheral length of a cross section of fibers extruded therefrom is L', and the cross-sectional area thereof is S', the transcription factor ⌈ is obtained by a formula: $\lceil = (L'^2/S')/(L^2/S)$.

Generally, with a reflection characteristic, etc. fibers are considered to be available when the transcription factor ⌈ is 0.6 or more, so that a value of 0.6 is also a reference for a reflection characteristic, etc. Therefore, the ratio $d/W_1$ should satisfy the following formula:

$$1 \leqq d/W_1 \tag{3a}$$

If the ratio $d/W_1$ is 30 or more, sticking of melt polymers does not occur, while curved or distorted fibers are obtained due to not only the above nonuniform pressure distribution in the first slits 101, but nonuniform cooling and solidifying of the melt polymers after extruded from the spinneret, failing to have a cross section with great transcription factor ⌈ as seen in a right area in FIG. 2. Therefore, the ratio $d/W_1$ should satisfy the following formula:

$$d/W_1 \leqq 30 \tag{3b}$$

It will be understood from the formulae (3a) and (3b) that the ratio $d/W_1$ of the interval "d" of the first slits 101 to the width $W_1$ of the first slits 101 should satisfy the formula (3).

If the manufacturing stability of fibers, lowering of a manufacturing cost of the spinneret, applicable thermoplastic polymers, spinning conditions, etc. are taken into account for producing reflection and interference more effectively, i.e. for obtaining greater transcription factor ⌈, the spinneret is formed, more preferably, to satisfy the following formulae:

$$0.1\ \text{mm} \leqq W_1 \quad (5)$$

$$2 \leqq d/W_1 \leqq 20 \quad (6)$$

Next, the desirable spinning conditions of a thermoplastic polymer will be described in the method of manufacturing fibers with optical function according to the present invention. The desirable spinning conditions of a thermoplastic polymer are to satisfy the following formulae when a shear rate is $\dot{\gamma}$, and a melt viscosity is $\eta$:

$$2\times10^2 \leqq \dot{\gamma} \leqq 1\times10^4 \quad (7)$$

$$2\times10 \leqq \eta \leqq 1\times10^3 \quad (8)$$

wherein the units are 1/s and Pa.s, respectively.

Figure 3:
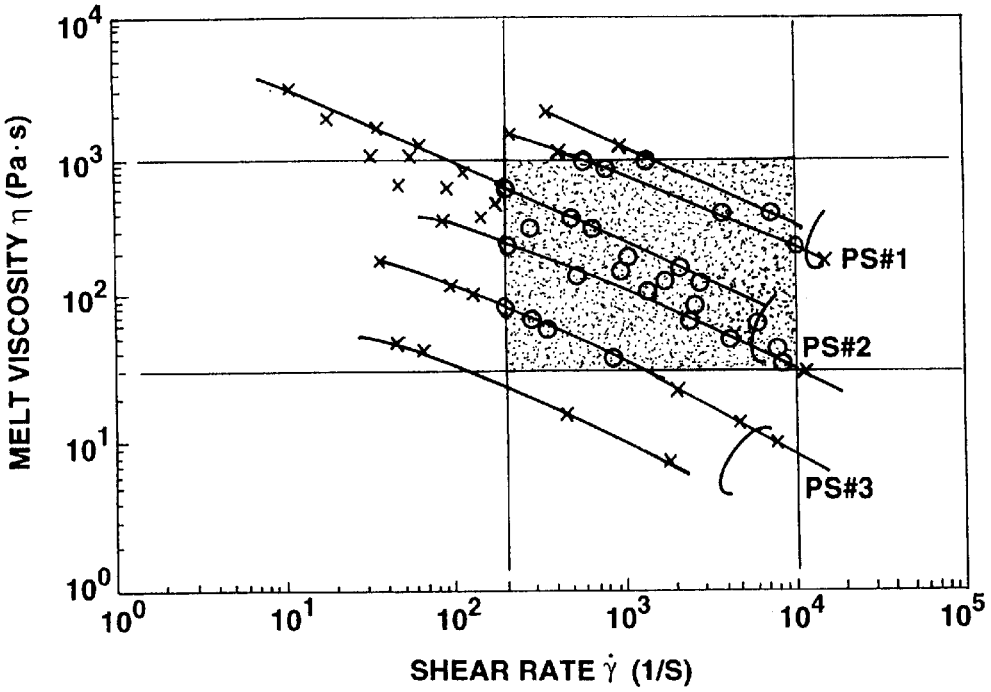
FIG. 3 is a view similar to FIG. 2, illustrating the relation between a shear rate and a melt viscosity of thermoplastic polymers (polystyrene)

Next, a description will be made with regard to the reason why the formulae (7) and (8) should be satisfied. FIG. 3 shows viscosity characteristics or flow curves of polystyrene (PS) as typical thermoplastic polymers, and an evaluation of the transcription factor ⌈. The polystyrene are three grades with different molecular weight: PS#1, PS#2, and PS#3. Referring to FIG. 3, the evaluation of the transcription factor ⌈ is indicated by ○ when it is good, and X when it is bad. It is noted that the transcription is considered to be great or excellent since fibers are judged to be available when the transcription factor ⌈ is 0.6 or more as described above. Moreover, in accordance with this evaluation, an area of excellent transcription factor ⌈ is indicated by smutching. Two flow curves of each grade result from a difference in spinning temperature. It will be understood from FIG. 3 that the transcription is excellent when the shear rate $\dot{\gamma}$ and the melt viscosity $\eta$ satisfy the formulae (7) and (8), respectively.

Figure 4:
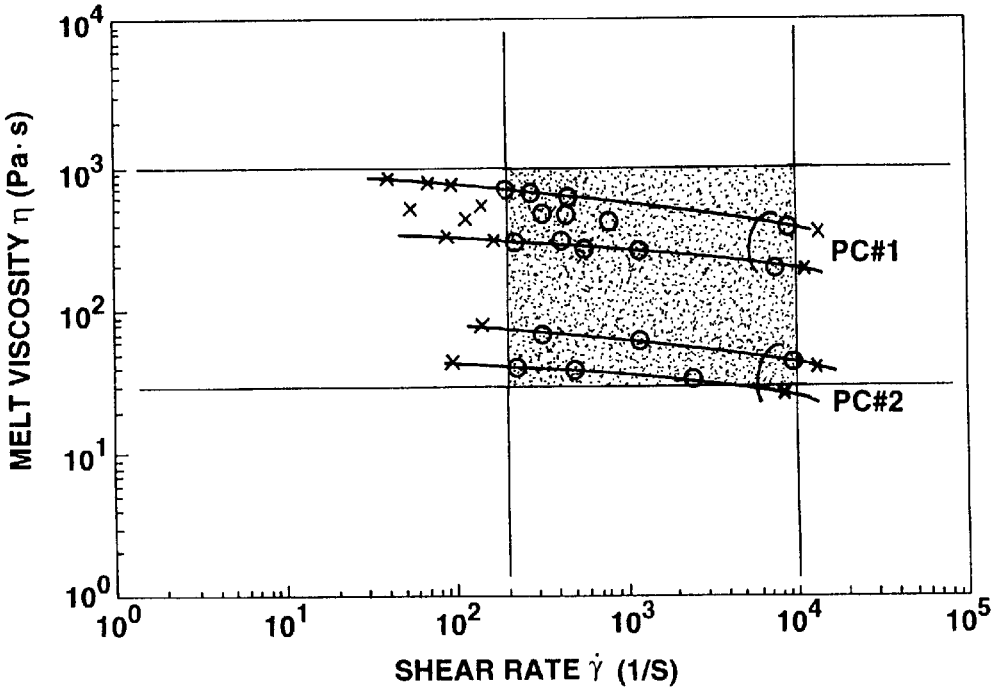
FIG. 4 is a view similar to FIG. 3, illustrating the relation between a shear rate and a melt viscosity of thermoplastic polymers (polycarbonate)

Moreover, referring to FIG. 4, the same test is carried out with regard to the other thermoplastic polymers, i.e. polycarbonate (PC), using two grades with different molecular weight: PC#1 and PC#2. As seen in FIG. 4, this test reveals that the transcription is excellent under the conditions defined by the formulae (7) and (8). Further, full examinations of the other thermoplastic polymers such as polypropylene and poly(ethylene terephthalate) reveal that the transcription is excellent under the above conditions.

The reason why the transcription is not great when failing to satisfy the above conditions in case of spinning thermoplastic polymers by using the spinneret of the present invention, which cannot clearly be explained at present, is roughly supposed as follows:

If the melt viscosity $\eta$ is small ($3\times10 \leqq \eta$) when the shear rate $\dot{\gamma}$ is small ($2\times10^2 \leqq \dot{\gamma}$), a cross section of polymer discharged from the spinneret tends inevitably to be round due to great contribution of a surface tension, resulting in small transcription. If the melt viscosity $\eta$ is great ($\eta \leqq 1\times10^3$), the transcription is improved in some degree, which is not satisfactory, however.

On the other hand, if the melt viscosity $\eta$ is small ($3\times10 \leqq \eta$) when the shear rate $\dot{\gamma}$ is great ($\dot{\gamma} \leqq 1\times10^4$), an amount of extruded polymer is increased, resulting in insufficient cooling and solidifying. If the melt viscosity $\eta$ is great ($\eta \leqq 1\times10^3$), a cross section of extruded polymer is deformed due to Barus effect, etc., failing to obtain great transcription or resulting in impossible spinning.

Full examinations reveal that thermoplastic polymers have substantially the same tendency even with some deviation in accordance with a kind of applied thermoplastic polymer. Examples of thermoplastic polymers to which the present invention is applicable are polyolefines such as polyetylene and polypropylene, polyesters such as poly (ethylene terephtalate) and poly(tetramethylene terephtalate), polystyrene, polycarbonate, poly (fluoroethylene), polyacetal, poly(phenylene sulfide), etc. Copolymers and mixed polymers having two or more of the above polymers can also be applied. A great effect can be obtained when the present invention is applied, particularly, to polycarbonate, etc. having great melt viscosity and thermal activation energy for viscous flow.

Figure 5B:
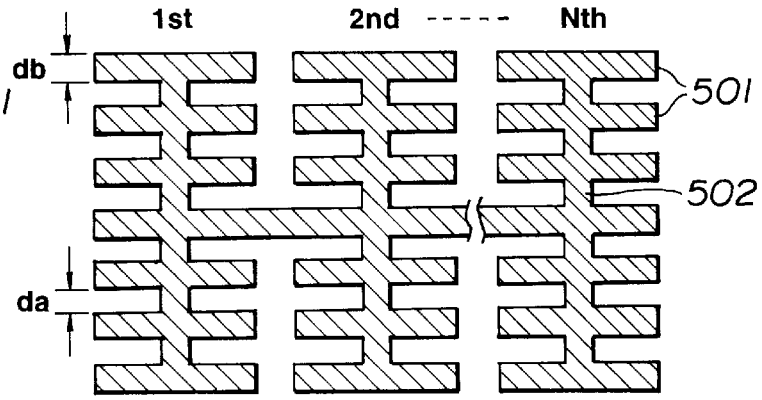

Referring to FIGS. 5A and 5B, preferred embodiments of the present invention will be described.

A first embodiment will be described. Polystyrene (weight average molecular weight: $3.1\times10^5$) is applied as a thermoplastic polymer, and is spun at high speed by using the spinneret ($W_1$=0.2 mm, $W_2$= 0.2 mm, $W_3$=4.0 mm, d=1.8 mm, and $d/W_1$=9) with the shape as shown in FIG. 1A under the conditions of 270° C. spinning temperature and $1\times10^3$ (1/s) shear rate. The melt viscosity $\eta$ is approximately $1\times10^2$ (Pa.s). Then, thermal drawing is carried out at a temperature of 105° C. to obtain near infrared ray reflecting fibers with a cross section shaped as shown in FIG. 5A.

In accordance with a scanning electron-microscopic (SEM) photograph of a cross section of obtained fibers, a dimensional ratio of the width $W'_1$ corresponding to "db" as shown in FIG. 5A to the width "d'" corresponding to "da" as shown in FIG. 5A, a peripheral length, and a cross-sectional area are measured to evaluate the transcription factor ⌈. Moreover, a reflection spectrum is evaluated at an incident angle of 0° and a receiving angle of 0° by using a microspectrophotometer of improved Model U-6000 manufactured by Hitachi Co., Ltd.

TABLE 1

| | Cross Section | | Reflection Spectrum | |
|---|---|---|---|---|
| | $d'/W'_1$ | Tran. Factor | Peak Wavelength ($\mu$m) | Reflectivity (%) |
| Embod. 1 | 1.43 | 0.70 | 1.0 | 65 |
| Embod. 2 | 1.56 | 0.62 | 0.55 | 59 |
| Embod. 3 | 2.0 | 0.65 | 5.0 | 62 |
| Embod. 4 | 1.22 | 0.60 | 5.0 | 52 |
| Ex. 1 | 1.67 | 0.38 | 1.0 | 30 |
| Ex. 2 | — | — | — | — |
| Ex. 3 | — | — | — | — |

TABLE 1 shows results of the above evaluations. Referring to TABLE 1, near infrared ray reflecting fibers are obtained with 65% reflectivity at 1.0 $\mu$m wavelength. That is, according to the first embodiment, fibers with optical function can be manufactured with accuracy, which satisfy the conditions of fibers with reflection and interference function as disclosed in JP-A 6-017349 (=U.S. Pat. No. 5,407,738).

A second embodiment will be described. Polycarbonate (weight average molecular weight: $2.77\times10^5$) as vacuum-dehydrated (120° C.×6 H) is applied as a thermoplastic polymer, and is spun at high speed by using the spinneret ($W_1$=0.1 mm, $W_2$=0.1 mm, $W_3$=1.0 mm, d=1.0 mm, and $d/W_1$=10) with the shape as shown in FIG. 1B under the conditions of 300° C. spinning temperature and $8\times10^2$ (1/s) shear rate. The melt viscosity $\eta$ is approximately $4\times10^2$ (Pa.s). Then, thermal drawing is carried out at a temperature of 170° C. to obtain green coloring fibers with a cross section shaped as shown in FIG. 5B.

In accordance with a scanning electron-microscopic (SEM) photograph of a cross section of obtained fibers, a dimensional ratio of the width $W'_1$ corresponding to "db" as shown in FIG. 5B to the width "d" corresponding to "da" as shown in FIG. 5B, a peripheral length, and a cross-sectional area are measured to evaluate the transcription factor ⌈. Moreover, a reflection spectrum is evaluated at an incident angle of 0° and a receiving angle of 0° by using a microspectrophotometer of improved Model U-6000 manufactured by Hitachi Co., Ltd.

TABLE 1 shows results of the above evaluations. Referring to TABLE 1, green coloring fibers are obtained with 59% reflectivity at 0.55 μm wavelength. That is, according to the second embodiment, fibers with optical function can be manufactured with accuracy, which satisfy the conditions of fibers with reflection and interference function as disclosed in JP-A 6-017349 (=U.S. Pat. No. 5,407,738).

A third embodiment will be described. Polycarbonate (weight average molecular weight: $2.77\times10^5$) as vacuum-dehydrated (120° C.×6 H) is applied as a thermoplastic polymer, and is spun by using the spinneret ($W_1$=0.15 mm, $W_2$=0.15 mm, $W_3$=2.0 mm, d=1.5 mm, and $d/W_1$=10) with the shape as shown in FIG. 1A under the conditions of 300° C. spinning temperature and $8\times10^2$ (1/s) shear rate. The melt viscosity η is approximately $4\times10^2$ (Pa.s). Then, thermal drawing is carried out at a temperature of 170° C. to obtain infrared ray reflecting fibers with a cross section shaped as shown in FIG. 5A.

In accordance with a scanning electron-microscopic (SEM) photograph of a cross section of obtained fibers, a dimensional ratio of the width $W'_1$ corresponding to "db" as shown in FIG. 5A to the width "d'" corresponding to "da" as shown in FIG. 5A, a peripheral length, and a cross-sectional area are measured to evaluate the transcription factor ⌈. Moreover, a reflection spectrum is evaluated at an incident angle of 0° and a receiving angle of 0° by using a microspectrophotometer of improved Model U-6000 manufactured by Hitachi Co., Ltd.

TABLE 1 shows results of the above evaluations. Referring to TABLE 1, infrared ray reflecting fibers are obtained with 62% reflectivity at 5.0 μm wavelength. That is, according to the third embodiment, fibers with optical function can be manufactured with accuracy, which satisfy the conditions of fibers with reflection and interference function as disclosed in JP-A 6-017349 (=U.S. Pat. No. 5,407,738).

A fourth embodiment will be described. Polypropylene is applied as a thermoplastic polymer, and is spun by using the spinneret ($W_1$=0.1 mm, $W_2$=0.1 mm, $W_3$=2.0 mm, d=2.0 mm, and $d/W_1$=20) with the shape as shown in FIG. 1C under the conditions of 255° C. spinning temperature and $2\times10^3$ (1/s) shear rate. The melt viscosity η is approximately 7×10 (Pa.s). Then, thermal drawing is carried out at a temperature of 120° C. to obtain infrared ray reflecting fibers with a cross section shaped as shown in FIG. 5A.

In accordance with a scanning electron-microscopic (SEM) photograph of a cross section of obtained fibers, a dimensional ratio of the width $W'_1$ corresponding to "db" as shown in FIG. 5A to the width "d'" corresponding to "da" as shown in FIG. 5A, a peripheral length, and a cross-sectional area are measured to evaluate the transcription factor ⌈. Moreover, a reflection spectrum is evaluated at an incident angle of 0° and a receiving angle of 0° by using a microspectrophotometer of improved Model U-6000 manufactured by Hitachi Co., Ltd.

TABLE 1 shows results of the above evaluations. Referring to TABLE 1, infrared ray reflecting fibers are obtained with 52% reflectivity at 5.0 μm wavelength. That is, according to the third embodiment, fibers with optical function can be manufactured with accuracy, which satisfy the conditions of fibers with reflection and interference function as disclosed in JP-A 6-017349 (=U.S. Pat. No. 5,407,738).

Referring to FIGS. 5A and 5B, comparative examples for the above embodiments will be described.

A first comparative example will be described. Polystyrene (weight average molecular weight: $3.1\times10^5$) is applied as a thermoplastic polymer, and is spun by using the spinneret ($W_1$0.2 mm, $W_2$=0.2 mm, $W_3$=4.0 mm, d=1.8 mm, and $d/W_1$=9) with the shape as shown in FIG. 1A (which is similar to that of the first embodiment) under the conditions of 270° C. spinning temperature and 9×10 (1/s) shear rate (which is smaller than that of the first embodiment). The melt viscosity η is approximately $5\times10^2$ (Pa.s). Then, thermal drawing is carried out at a temperature of 105° C. to obtain near infrared ray reflecting fibers with a cross section shaped as shown in FIG. 5A.

In accordance with a scanning electron-microscopic (SEM) photograph of a cross section of obtained fibers, a dimensional ratio of the width $W'_1$ corresponding to "db" as shown in FIG. 5A to the width "d'" corresponding to "da" as shown in FIG. 5A, a peripheral length, and a cross-sectional area are measured to evaluate the transcription factor ⌈. Moreover, a reflection spectrum is evaluated at an incident angle of 0° and a receiving angle of 0° by using a microspectrophotometer of improved Model U-6000 manufactured by Hitachi Co., Ltd.

TABLE 1 shows results of the above evaluations. Referring to TABLE 1, infrared ray reflecting fibers are obtained only with 30% reflectivity at 1.0 μm wavelength.

A second comparative example will be described. Polycarbonate (weight average molecular weight: $2.77\times10^5$) as vacuum-dehydrated (120° C.×6 H) is applied as a thermoplastic polymer, and is spun at high speed by using the spinneret ($W_1$=0.2 mm, $W_2$=0.2 mm, $W_3$=0.5 mm, d=0.1 mm, and $d/W_1$=0.5) with the shape as shown in FIG. 1B under the conditions of 300° C. spinning temperature and 8×10 (1/s) shear rate. The melt viscosity η is approximately $4\times10^2$ (Pa.s). Then, thermal drawing is carried out at a temperature of 170° C. to obtain green coloring fibers with a cross section shaped as shown in FIG. 5B.

According to an observation of a scanning electron-microscopic (SEM) photograph of a cross section of obtained fibers, the fibers have an elliptic cross section, failing to arrive at a coloring level.

A third comparative example will be described. Polycarbonate (weight average molecular weight: $2.77\times10^5$) as vacuum-dehydrated (120° C.×6 H) is applied as a thermoplastic polymer, and is spun by using the spinneret ($W_1$=0.3 mm, $W_2$=0.15 mm, $W_3$=2.0 mm, d=0.1 mm, and $d/W_1$=0.33) with the shape as shown in FIG. 1A (which is similar to that of the third embodiment) under the conditions of 315° C. spinning temperature and $1\times10^2$ (1/s) shear rate. The melt viscosity η is approximately $3\times10^2$ (Pa.s). Then, thermal drawing is carried out at a temperature of 170° C. to obtain infrared ray reflecting fibers with a cross section shaped as shown in FIG. 5A.

According to an observation of a scanning electron-microscopic (SEM) photograph of a cross section of obtained fibers, the fibers have an elliptic cross section in the same way as in the second comparative example, failing to arrive at an infrared ray reflecting level.

As described above, according to the present invention, fibers can be manufactured having great transcription factor and reflection and interference function with accuracy and a reduced manufacturing cost.

Moreover, chips of the fibers with optical function according to the present invention can be used as new bright members contained in paintings and coatings.

Having described the present invention in connection with the preferred embodiments, it is noted that the present invention is not limited thereto, and various changes and modifications can be made without departing from the spirit of the present invention.

What is claimed is:

1. A method of manufacturing fibers, comprising the steps of:

preparing a thermoplastic polymer; and spinning said thermoplastic polymer by a spinneret to form the fibers, said spinneret having an opening with a cross-section having a first group of first slits arranged parallel to each other and a second slit arranged to intersect said first slits, said spinneret being formed to satisfy a predetermined relation between a length of said first slits and a width of said second slit, said thermoplastic polymer being spun under the following conditions:

$$2\times10^2 \leqq \gamma \leqq 1\times10^4$$

$$3\times10 \leqq \eta \leqq 1\times10^3$$

wherein $\gamma$ is a shear rate (1/s) and $\eta$ is a melt viscosity (Pa.s).

2. A method as claimed in claim 1, wherein said first slits are shaped in a rectangle.

3. A method as claimed in claim 1, wherein said first slits are shaped in a rectangle with semi-circular ends.

4. A method as claimed in claim 2, wherein said first slits are of the same width and are disposed at regular intervals.

5. A method as claimed in claim 4, wherein said first slits are of the same length.

6. A method as claimed in claim 4, wherein said first slits are of different lengths.

7. A method as claimed in claim 6, wherein said first slits are of a length increased gradually from one end of said second slit to another end of said second slit.

8. A method as claimed in claim 4, wherein said first slits are wider at ends than at an intersection with said second slit.

9. A method as claimed in claim 1, wherein said first group of first slits is connected to a second group of first slits by a connecting slit.

10. A method as claimed in claim 9, wherein said connecting slit is placed in a middle of said first slits.

11. A method as claimed in claim 4, wherein said first slits are formed to satisfy the following formulae:

$$0.03\ \text{mm} \leqq W_1$$

$$1 \leqq d/W_1 \leqq 30$$

wherein $W_1$ is the width of said first slits and d is an interval between two of said first slits.

12. A method as claimed in claim 1, wherein said thermoplastic polymer is a polymer selected from the group consisting of polyolefines, polyesters, polystyrene, polycarbonate, poly(fluoroethylene), polyacetal, and poly (phenylene sulfide).

13. A method as claimed in claim 12, wherein said thermoplastic polymer is in a form of one of a copolymer and mixed polymer having two or more of polymers listed in claim 12.

14. A method of manufacturing fibers, comprising the steps of:

preparing a thermoplastic polymer; and spinning said thermoplastic polymer by a spinneret to form the fibers, said spinneret having an opening with a cross-section having a first group of first slits arranged parallel to each other and a second slit arranged to intersect said first slits, said spinneret being formed to satisfy a predetermined relation between a length of said first slits and a width of said second slit, said first slits being wider at ends than at an intersection with said second slit.

15. A method as claimed in claim 14, wherein said first slits are of the same length.

16. A method as claimed in claim 14, wherein said first group of first slits is connected to a second group of first slits by a connecting slit.

17. A method as claimed in claim 16, wherein said connecting slit is placed in a middle of said first slits.

18. A method of manufacturing fibers, comprising the steps of:

preparing a thermoplastic polymer; and spinning said thermoplastic polymer by a spinneret to form the fibers, said spinneret having an opening with a cross-section having a first group of first slits arranged parallel to each other and a second slit arranged to intersect said first slits, said spinneret being formed to satisfy a predetermined relation between a length of said first slits and a width of said second slit, said first slits being rectangular, said first slits being of the same width and disposed at regular intervals, said first slits being formed to satisfy the following formulae:

$$0.03\ \text{mm} \leqq W_1$$

$$1 \leqq d/W_1 \leqq 30$$

wherein $W_1$ is a width of said first slits and d is an interval between two of said first slits.

19. A method as claimed in claim 18, wherein said first slits are formed to satisfy the following formulae:

$$0.1\ \text{mm} \leqq W_1$$

$$2 \leqq d/W_1 \leqq 20.$$

20. A method as claimed in claim 18, wherein said first group of first slits is connected to a second group of first slits by a connecting slit.

21. A method as claimed in claim 20, wherein said connecting slit is placed in a middle of said first slits.

22. A method as claimed in claim 12, wherein said polymer is a polyolefine selected from the group consisting of polyethylene and polypropylene.

23. A method as claimed in claim 12, wherein said polymer is a polyester selected from the group consisting of poly(ethylene terephtalate) and poly(tetramethylene terephtalate).

* * * * *